United States Patent [19]

Lüth

[11] 4,138,865

[45] Feb. 13, 1979

[54] CIRCULAR KNITTING MACHINE HAVING A MULTIPLE SELECTION SYSTEM FOR THE NEEDLES

[75] Inventor: Claus-Peter Lüth, Emmingen, Fed. Rep. of Germany

[73] Assignee: Macchine Tessili Circolari Matec S.p.A., Scandicci, Italy

[21] Appl. No.: 854,744

[22] Filed: Nov. 25, 1977

[30] Foreign Application Priority Data

Nov. 29, 1976 [IT] Italy ..... 9682

[51] Int. Cl.[2] ..... D04B 15/78

[52] U.S. Cl. ..... 66/219; 66/222; 66/223

[58] Field of Search ..... 66/50 R, 50 B, 25, 154 A

[56] References Cited

U.S. PATENT DOCUMENTS

| | | | |
|---|---|---|---|
| 2,067,877 | 1/1937 | Lawson et al. | 66/50 R |
| 3,442,097 | 5/1969 | Lonati | 66/50 R |
| 3,641,787 | 2/1972 | Robottom | 66/50 R |
| 3,811,297 | 5/1974 | Hamma | 66/50 R |
| 3,815,383 | 6/1974 | Hamma | 66/50 R |
| 3,855,819 | 12/1974 | Sawazaki | 66/50 R |
| 3,998,073 | 12/1976 | Lüth | 66/50 R |
| 4,038,837 | 8/1977 | Güell | 66/50 R |

FOREIGN PATENT DOCUMENTS

| | | | |
|---|---|---|---|
| 362787 | 8/1962 | Switzerland | 66/50 R |
| 483511 | 2/1970 | Switzerland | 66/50 R |
| 503952 | 3/1976 | U.S.S.R. | 66/50 R |

*Primary Examiner*—Wm. Carter Reynolds
*Attorney, Agent, or Firm*—Haseltine, Lake & Waters

[57] ABSTRACT

A circular knitting machine has a needle selection system which can be set up to provide selection under electronic control, or to provide for manual selection. The selection system has a plurality of slidable selection cams which are controlled by an electro-magnetic system to act on rocking selector jacks, the electro-magnetic system being operated by an electronic control program. For manual selection, the electro-magnetic system serves to hold all of the selection cams in an excluded position and selection is obtained by manually insertable cams which act on the selector jacks.

3 Claims, 6 Drawing Figures

22
28
30
32
36
38
18
20
24
24A
24B
24C
24E
34
40
42
44
A
B
C
D
E
f36
f1
II

Fig.3
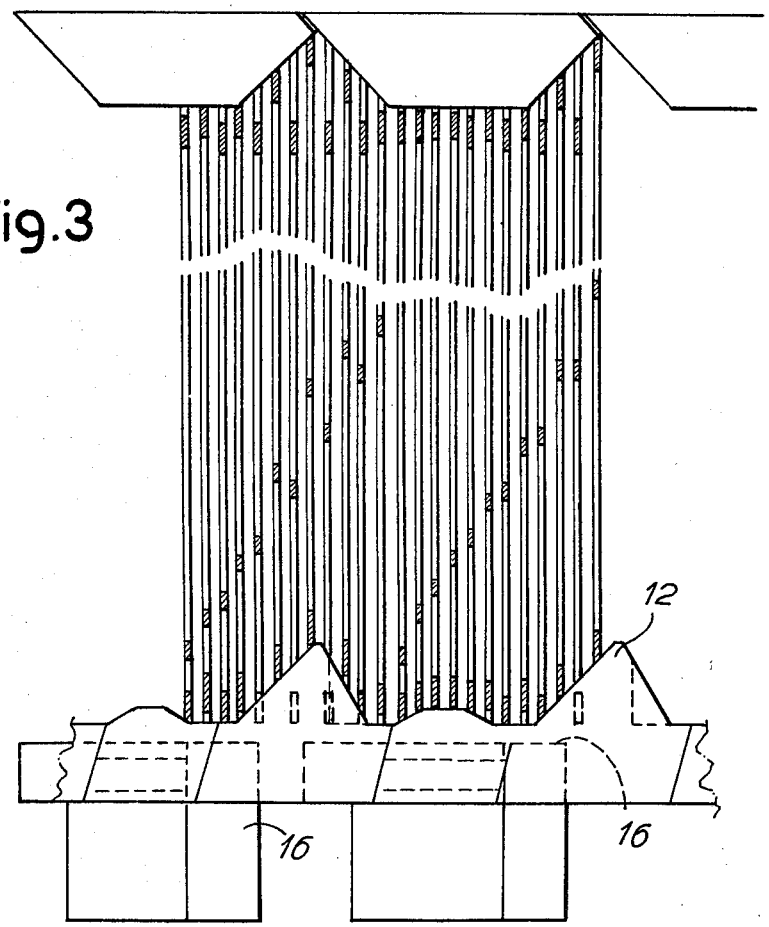
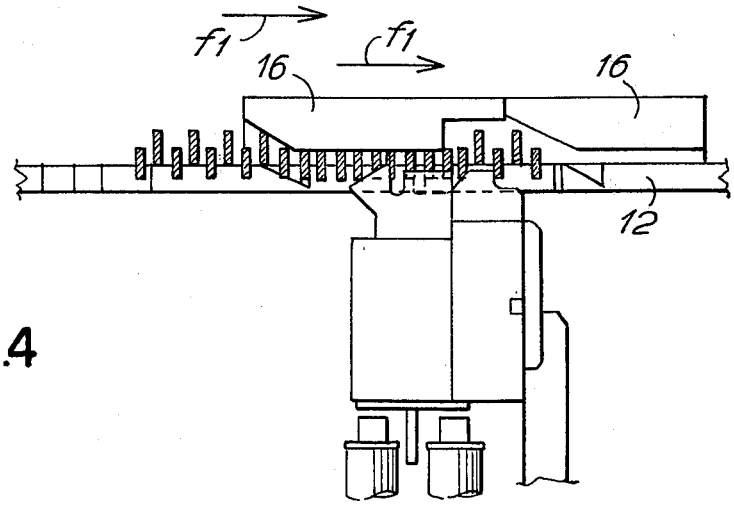
Fig.4

CIRCULAR KNITTING MACHINE HAVING A MULTIPLE SELECTION SYSTEM FOR THE NEEDLES

FIELD OF THE INVENTION

The present invention relates to a circular knitting machine and more particularly to a circular knitting machine having a multiple selection system for the needles of the machine.

SUMMARY OF THE INVENTION

According to the invention there is provided in a circular knitting machine, a needle selection system, a needle cylinder, jacks having butts, said jacks being mounted on the needle cylinder for movement longitudinally of the needle cylinder and also for movement inwardly and outwardly with respect to the needle cylinder, and stationary cam means operative to move the jacks outwardly of the needle cylinder prior to selection. The selection system comprises a stack of selection cams operative to cause movement of selected jacks inwardly of the needle cylinder, lifting cam means downstream of the selection cams to raise those jacks which remain in a position outwardly of the needle cylinder, each said selection cam being a slider cam movable between an operative and inoperative position, resilient means operative to bias each slider cam into its operative position, electro-magnetic means for retaining each selection cam in its inoperative position, each selection cam having means defining a thrust profile engageable by the butt of a said jack to thrust the selection cam towards its inoperative position, means defining a lowering profile engageable with the butt of the jack to cause lowering thereof when the selection cam is in its operative position, and means defining a zone between the thrust profile and the lowering profile. The electromagnetic means is operated during passage of the butt across said zone between the thrust profile and the lowering profile, so as to determine the subsequent state of the selection cam, the selection system further comprising thrust cam means downstream of the selection cams to act on the butts of those jacks which have been lowered by the lowering profiles of the selection cams and to thrust said jacks inwardly relative to the needle cylinder whereby these jacks are excluded from being raised by the lifting cam means, and selectively operable means to provide an alternative manual selection.

BRIEF DESCRIPTION OF THE DRAWING

An embodiment of the invention will now be described, by way of example only, with reference to the accompanying drawings, in which:

FIG. 3 is a fragmentary elevation view of a cam shell of the machine;

FIG. 4 is a fragmentary plan view showing the selection system and associated jacks.

DESCRIPTION OF THE PREFERRED EMBODIMENT

Figure 1:
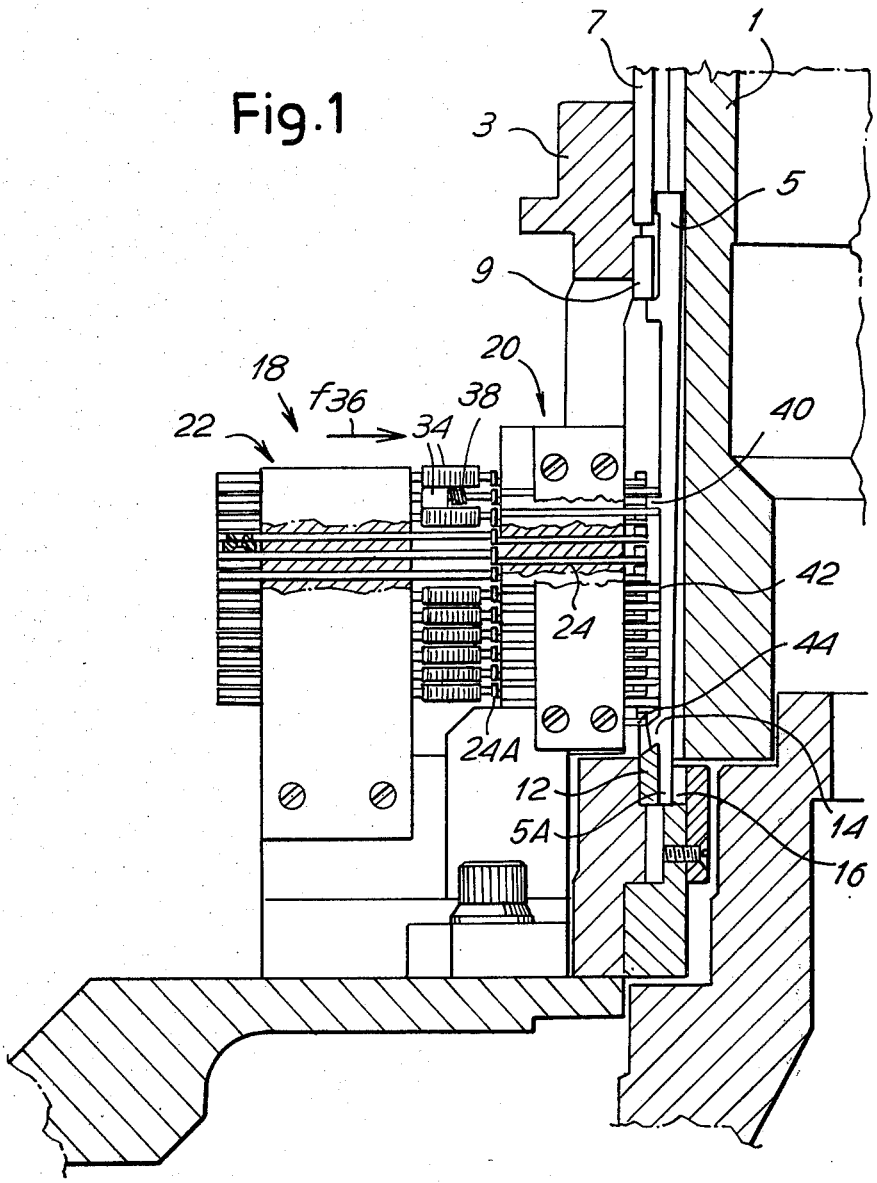
FIG. 1 is a fragmentary longitudinal section of a needle cylinder and selection system of a circular knitting machine in accordance with the present invention.

In the drawings, 1 denotes a needle cylinder which is surrounded by a shell 3 on which cams are provided to act on the needles and jacks, the jacks being designated by numeral 5 and being intended to cooperate with a selection system to be described. The jacks 5 are rocking selector jacks, and each jack 5 is angularly movable about its upper end, which is between the base of a respective groove of the needle cylinder 1 and a cam 7 of the cam shell 3. The shell 3 also comprises a cam 9 for lowering the jacks and a lifting cam 12 which is arranged to act on butts 14 provided on the jacks 5 adjacent the lower ends 5A thereof. The lower ends 5A of the jacks 5 can be moved radially between a cam 16 and the cam 12, the cam 16 being designed to push the lower ends of the jacks 5 radially outwardly.

The selection system, generally denoted by numeral 18, comprises a frame including a block 20 located adjacent the outer periphery of the needle cylinder and supported by the cam shell 3, and having a set of seats for slidable selection cams 24. Rearwardly of the block 20 there is provided an assembly 22 for selective electromagnetic control. The whole system is secured to the base plate of the machine through a single support.

More particularly, the block 20 has sliding seats for a plurality of slider cams 24, each of which has at its rear end a flat, upstanding, retaining strip 24A. The electromagnetic control assembly 22 has several pairs of pole pieces 32 each arranged to act on a respective one of the retaining strips 24A. The control assembly 22 comprises a single permanent magnet 28 flanked by blocks 30 containing bars 32 which project to form the pole pieces. On these bars, electromagnetic windings 34 are provided, which — when excited — neutralize the magnetic flux created by the permanent magnet 28 in the respective pair of pole pieces. Each slider cam 24 can be retained in a retracted, inoperative, position by the flux in the pole pieces against the action of a spring 36 guided on a rod 38 and acting to bias the slider cam 24 in the direction of arrow f36 towards the needle cylinder; if the windings 34 are excited, the retaining magnetic flux in the pole pieces is neutralized and the spring 36 pushes the slider cam 24 in the direction of the arrow f36 into an active position.

As is shown in the drawing, each slider cam 24 has an edge 24B comprising a thrust profile which lies in the plane of the slider cam and which is radially inclined with respect to the needle cylinder, a groove 24C, and an edge 24E comprising a lowering profile which is inclined to the plane of the slider cam in order to form a ramp to lower butts 40 of the jacks 5 which advance according to the arrow f1 corresponding to the direction of rotation of the needle cylinder.

Stationary thrust cams 42 are mounted on the block 20 adjacent to, but after, the slider cams 24. The thrust cams 42 can be inserted and excluded manually. These cams 42 have a radially inclined thrust profile to push the jacks 5 towards the base of their associated cylinder grooves by acting on the corresponding butts of these jacks; the action of thrust cams 42 takes place in a zone in which the cam 16 is absent, and before the action of the lifting cam 12 begins.

Beneath the slider cams 24 there is a cam 44 which has an inclined profile similar to that of the edge 24E, and intended to act on the butts 14 of jacks 5 to lower the jacks.

The cams 42 and the cam 44 are inserted and excluded manually, for instance by a sliding and locking action.

The selection system described can work in two different selection modes — in the first mode, a relatively complex selection can be obtained with electronic program control, and in the second mode the selection is arranged manually.

Figures 2, 2A:
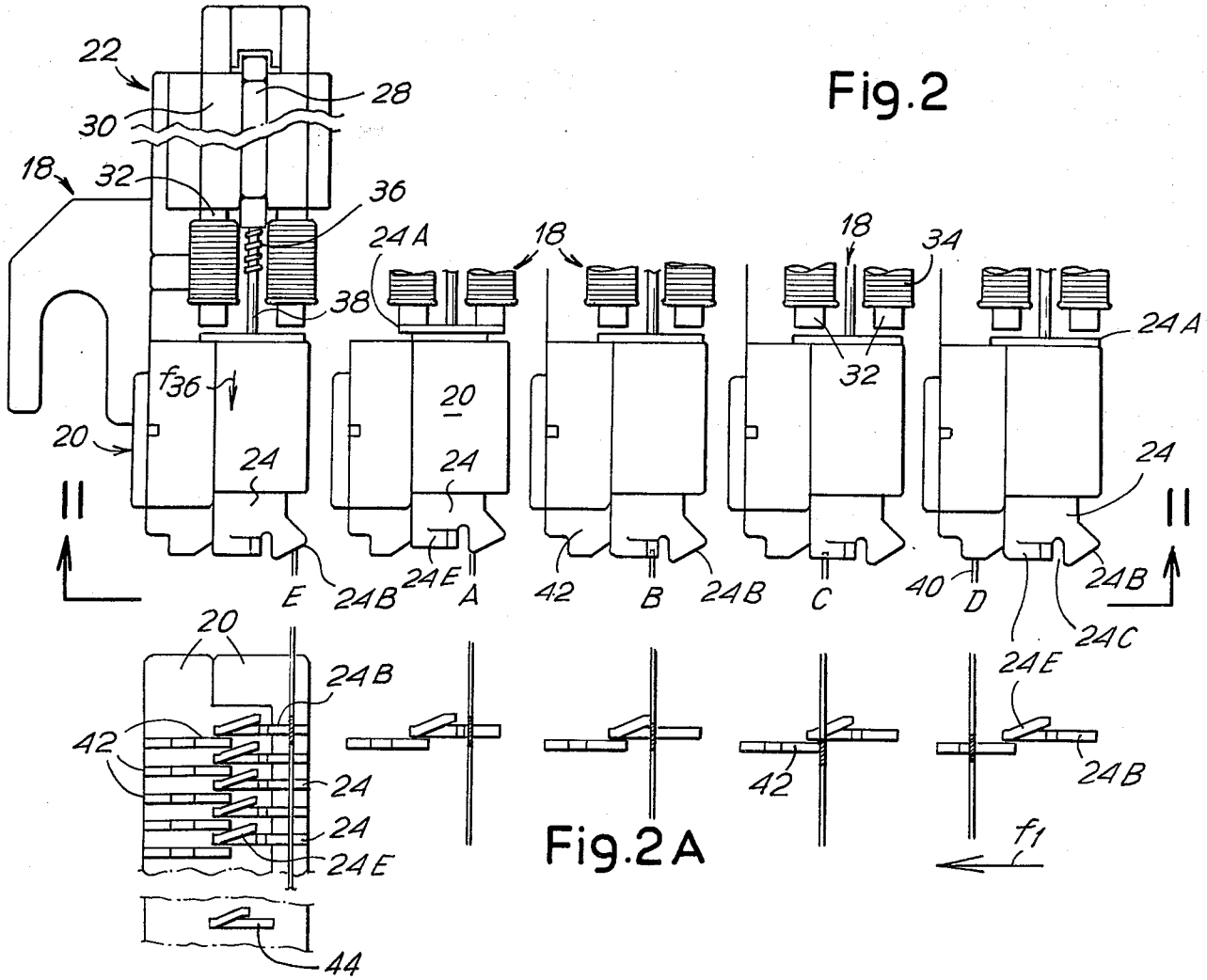
FIG. 2 is a plan view showing schematically successive stages in the operation of the selection system.
FIG. 2A is an elevation view according to line II—II of FIG. 2.
Figure 5:
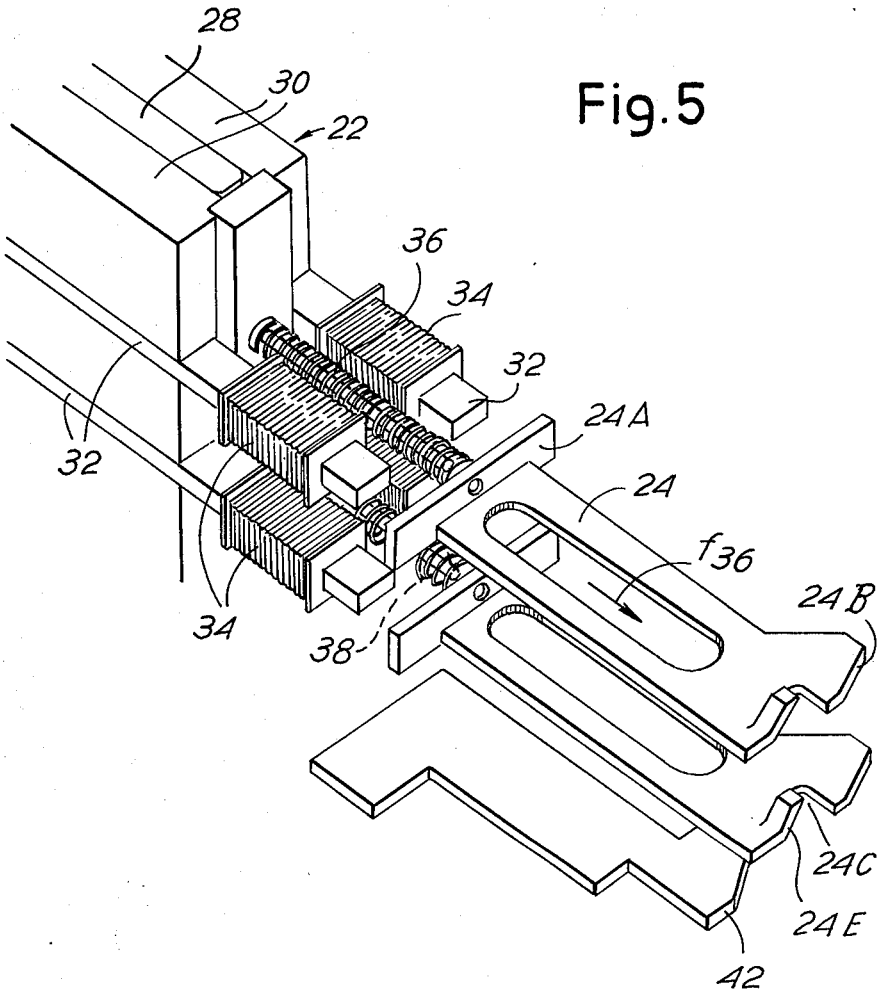
FIG. 5 is a fragmentary perspective view of the selection system.

In the first mode the operation is as follows. A butt 40 of a jack 5 is moving in the direction of arrow f1 and is pushed radially outwardly by the cam 16 to contact the inclined edge 24B of a slider cam 24. When the butt 40 advances according to arrow f1 to the position denoted by E in FIG. 2 it acts on the edge 24B to push the slider cam 24 against the action of the spring 36, i.e. in a direction opposite the arrow f36; thus the retaining strip 24A of the slider cam 24 in question is moved towards the corresponding pole pieces 32, as shown at position A in FIG. 2. If the windings 34 are not excited, the slider cam 24 will be retained in this retracted, inoperative, position by the magnetic flux in the pole pieces and the butt 40 concerned is not further moved and passes above the thrust cam 42; conversely, if the windings 34 are excited, the slider cam 24 will no longer be retained and the spring 36 will return the cam according to arrow f36 into its active position, as shown at position B in FIG. 2. Exitation of the windings will occur when the jack butt 40 is passing across the groove 24C between the inclined edges 24B and 24E of the slider cam. Thus, the groove 24C forms a zone between the thrust profile of inclined edge 24B and the lowering porfile of inclined edge 24E during which the windings are excited. Then butt 40 contacts the lower surface of the edge 24E and is lowered as may be seen by comparing positions D and C. The butt 40 is lowered by the edge 24E to the level of the thrust cam 42. The thrust cam 42 (which is always present when the system works electro-magnetically and, according to the desired pattern, when the system works with a fixed manual selection) pushes, the butt 40 and thus the jack 5, the cam 16 being interrupted to permit such movement. Therefore, by exciting the windings 34, or by not exciting the windings, there is either obtained an inwards movement of the lower end of the jack 5, or the lower end of the jack 5 is maintained in an outer position. In this manner there is provided a selection of jacks for the cam 12, which raises the jacks (and thus the corresponding needles) only if they have not been pushed back inwardly towards the base of their associated cylinder grooves by the thrust cams 42. The selection which is determined through the selective exitation of the windings 34 can be obtained by a program of the electronic control type.

In the second selection mode, all the cams 24 are excluded by being held in their retracted positions by the electromagnetic control assembly and cams 42 are selected manually, some being kept inserted and some excluded. The cam 44 is inserted to lower all of the jacks by acting on the butts 14 of the jacks. Depending on the presence and absence of appropriate butts on the jacks, and on the selection of the cams 42, selected jacks, and thus the corresponding needles are raised into the active position; in this mode there is no electronic selection. The manual selection may be the same or different from the electronic selection.

By the system described it is possible to obtain differences in the selection controls, with significant advantages with respect to conventional selection systems.

What is claimed is:

1. In a circular knitting machine, a needle selection system, a needle cylinder, jacks having butts, said jacks being mounted on the needle cylinder for movement longitudinally of the needle cylinder and also for movement inwardly and outwardly with respect to the needle cylinder, and stationary cam means operative to move the jacks outwardly of the needle cylinder prior to selection, said selection system comprising a stack of selection cams operative to cause movement of selected jacks inwardly of the needle cylinder, lifting cam means downstream of the selection cams to raise those jacks which remain in a position outwardly of the needle cylinder, each said selection cam being a slider cam movable between an operative and inoperative position, resilient means operative to bias each slider cam into its operative position, electromagnetic means for retaining each selection cam in its inoperative position, each selection cam having means defining a thrust profile engageable by the butt of one of said jacks to thrust the selection cam towards its inoperative position, means defining a lowering profile engageable with said butt of said one jack to cause lowering thereof when the selection cam is in its operative position, and means defining a zone between the thrust profile and the lowering profile, said electro-magnetic means being operated during passage of said butt across the said zone between the thrust profile and the lowering profile, so as to determine the subsequent state of the selection cam, thrust cam means downstream of the selection cams to act on said butt of said one jack which has been lowered by the lowering profile of the selection cam and to thrust said jack inwardly relative to the needle cylinder whereby said jack is excluded from being raised by the lifting cam means, and selectively operable means to provide an alternative manual selection.

2. A circular knitting machine according to claim 1, wherein the electro-magnetic means comprises a permanent magnet having a plurality of pole pieces, at least one individual pole piece being associated with a respective one of the selection cams to retain magnetically the selection cam in its inoperative condition, and an electro-magnetic winding on each of the pole pieces, each said winding being selectively energizable to neutralize the magnetic flux in the associated pole piece whereby to permit the respective selection cam to be returned to its operative position by the bias of the resilient means.

3. A circular knitting machine according to claim 1, wherein the said means for providing a manual selection comprises lowering cam means, said lowering cam means being manually insertable to cause lowering of all of the jacks to enable selection to be effected by the thrust cam means, said thrust cam means being manually insertable to obtain the required selection, said electro-magnetic means retaining the selection cams in their inoperative positions when the machine is set up for operation under manual selection.

* * * * *